US006779286B2

(12) United States Patent
Shaffer et al.

(10) Patent No.: US 6,779,286 B2
(45) Date of Patent: Aug. 24, 2004

(54) CONVERTIBLE MULTI-POSITION PANEL DISPLAY SYSTEM

(76) Inventors: William H. Shaffer, P.O. Box 2174, Cinnaminson, NJ (US) 08077; Bruce R. Shaffer, P.O. Box 2174, Cinnaminson, NJ (US) 08077

( * ) Notice: Subject to any disclaimer, the term of this patent is extended or adjusted under 35 U.S.C. 154(b) by 0 days.

(21) Appl. No.: 10/316,658

(22) Filed: Dec. 10, 2002

(65) Prior Publication Data

US 2004/0107618 A1 Jun. 10, 2004

(51) Int. Cl.[7] ..... G09F 15/00
(52) U.S. Cl. ..... 40/606.16; 40/748
(58) Field of Search ..... 40/605, 606.01, 40/606.16, 606.19, 610, 733, 748, 749

(56) References Cited

U.S. PATENT DOCUMENTS 4,194,313 A * 3/1980 Downing ..... 40/610
4,214,392 A * 7/1980 Virsen ..... 40/605
5,131,849 A * 7/1992 Perrero ..... 434/281
5,626,926 A * 5/1997 Roberts ..... 428/14
5,775,919 A * 7/1998 Gardner ..... 434/408

* cited by examiner

*Primary Examiner*—S. Joseph Morano
*Assistant Examiner*—Robert J. McCarry, Jr.
(74) *Attorney, Agent, or Firm*—Stuart M. Goldstein

(57) ABSTRACT

A panel display system comprises three separate, flat display panels, each with surfaces allowing for the easy, temporary attachment and ready removal of photographs, brochures, documents, visual aids or the like. One side of one of the panels is rotatably connected, by hinges, to one side of a second panel. The other side of the first panel is rotatably connected, by hinges, to one side of a third panel, such that the first panel becomes the central display panel in a three panel display configuration, with the other two panels in adjacent alignment. By rotating the panels about their hinges, the display system can readily, easily and quickly be converted to a single panel display or a dual panel display, without the use of tools or any other appliance. A header is provided for ready placement on and attachment to the display system, in each of its configurations. Support members are provided for use when the system is configured as a single panel display.

28 Claims, 8 Drawing Sheets

CONVERTIBLE MULTI-POSITION PANEL DISPLAY SYSTEM

Self-standing display systems are commonly used to exhibit a wide variety of written information and material about products and services. One such system generally employs flat panel members with surfaces to which photographs, brochures, textual documents, visual aids, or like material can be temporarily, but securely attached for display. Attachment is accomplished by the use of commonly available means, e.g. Velcro®, pushpins, tape, or the like. The adaptability of such known systems for use with various size displays, however, is limited because the configurations of such systems restrict their usage. More specifically, a single panel display is obviously restricted by its size to a set number of display items. If a larger display is needed, one or more additional panels must be added, usually by manual assembly. This process requires that extra panels, as well as tools for the assembly, be transported to the display site and the display with additional panels, must literally be built onsite. By the same token, there are occasions where a small display is necessary and only a multi-panel display is available. Using a display which is over-sized may detract from the overall presentation. As a result, disassembly is required to obtain the optimal display unit which is needed. Again, tools are required and the extra unused panels must be dealt with.

SUMMARY OF THE INVENTION

It is the object of the present invention to address and overcome the limitations and disadvantages of prior panel display systems.

It is the object of the present invention to provide a panel display system which is easily and readily convertible to different positions for use, depending on the size of the display system needed and the amount of material to be exhibited.

It is another object of the present invention to provide a panel display system which is easily, quickly, and readily convertible for use to a number of different display positions.

It is still another object of the present invention to provide a panel display system which is easily, quickly, and readily convertible for use as a single panel display, a dual panel display, or a three panel display.

It is a further object of the present invention to provide a panel display system which is easily, quickly, and readily convertible for use to a number of different display positions, without employing the use of tools.

It is still another object of the present invention to provide a panel display system which is easily and readily transportable and which can be set up quickly at the display site.

It is another object of the present invention to provide a panel display system which is lightweight, but sturdy and durable, such that it can be reused over and over again, in the various display configurations.

It is a further object of the present invention to provide a panel display system which is a self-contained unit and which can be converted to various display positions without detachment of panel components.

These and other objects are accomplished by the herein panel display system which comprises three separate, flat display panels, each with surfaces allowing for the easy, temporary attachment and ready removal of photographs, brochures, documents, visual aids or the like. One side of one of the panels is rotatably connected, by hinges, to one side of a second panel. The other side of the first panel is rotatably connected, by hinges, to one side of a third panel, such that the first panel becomes the central display panel in a three panel display configuration, with the other two panels in adjacent alignment. By rotating the panels about their hinges, the display system can readily, easily and quickly be converted to a single panel display or a dual panel display, without the use of tools or any other appliance. A header is provided for ready placement on and attachment to the display system, in each of its configurations. Support members are provided for use when the system is configured as a single panel display.

The novel features which are considered as characteristic of the invention are set forth in particular in the appended claims. The panel display system itself, however, both as to its design, construction, and use, together with additional features and advantages thereof, are best understood upon review of the following detailed description with reference to the accompanying drawings.

DETAILED DESCRIPTION OF THE INVENTION

Figure 1:
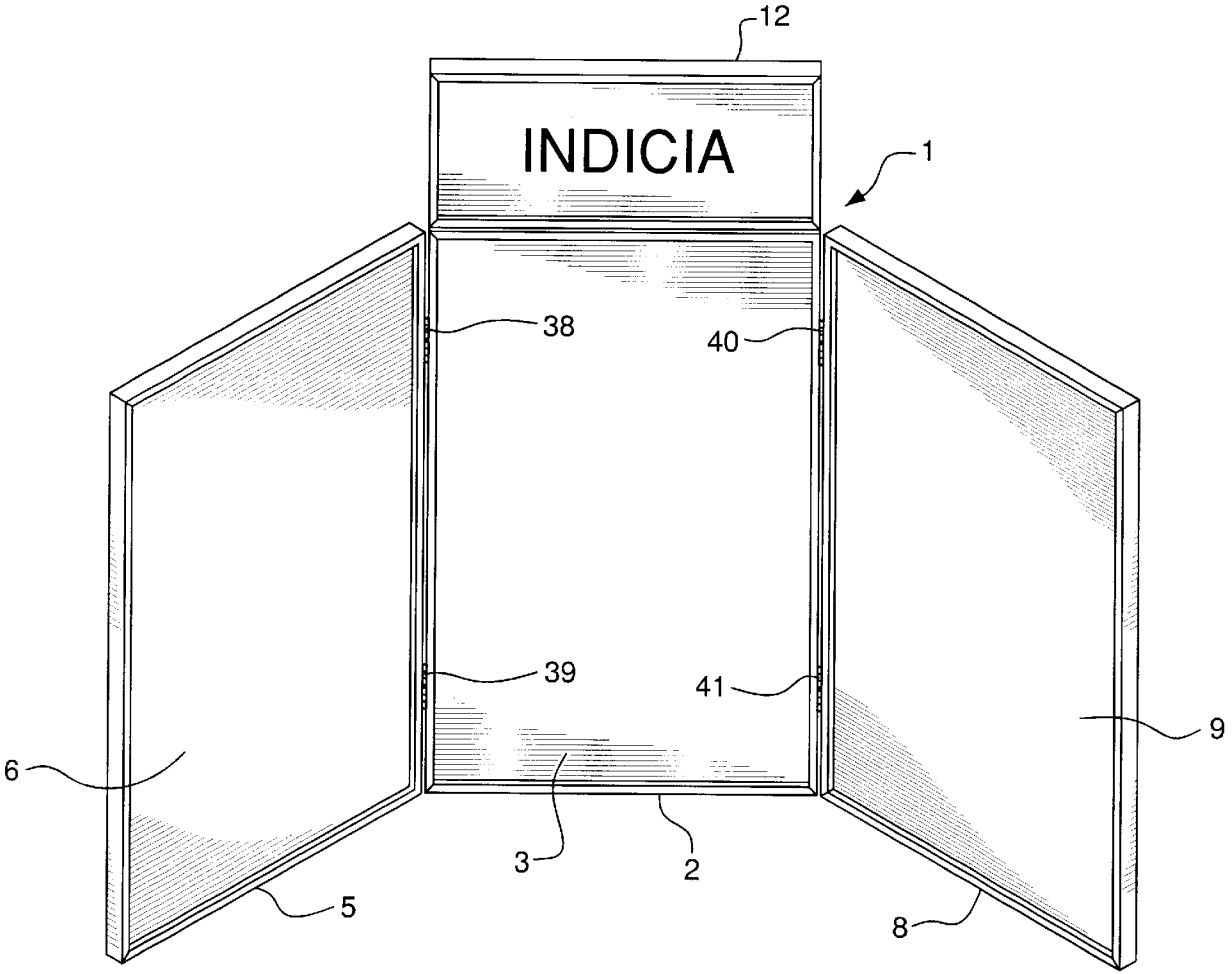
FIG. 1 shows a front view of the panel display system in its three panel display configuration.

Panel display system 1 comprises panels 2, 4, and 6. It is contemplated that the outside surfaces of each of the panels will be made of sturdy fabric material, Velcro®, corkboard, or similar material which allows surface attachment of photographs, brochures, pictures, written documents, or similar paper or products by Velcro®, push pins, tape or the like. The panel surface can also consist of paper, for drawing or writing. The invention is not to be considered restricted by the type of panel surface material which is used, the manner of attachment to the surface, or the use to which the surface is put.

Panel 2 is connected on one side to panel 5 by rotatable hinges 38 and 39 and on the other side to panel 8 by rotatable hinges 40 and 41. The freely rotatable nature of hinges 38, 39, 40, and 41 allows panels 2 and 5 and panels 2 and 8 to freely rotate in relation to each other.

Figure 2:
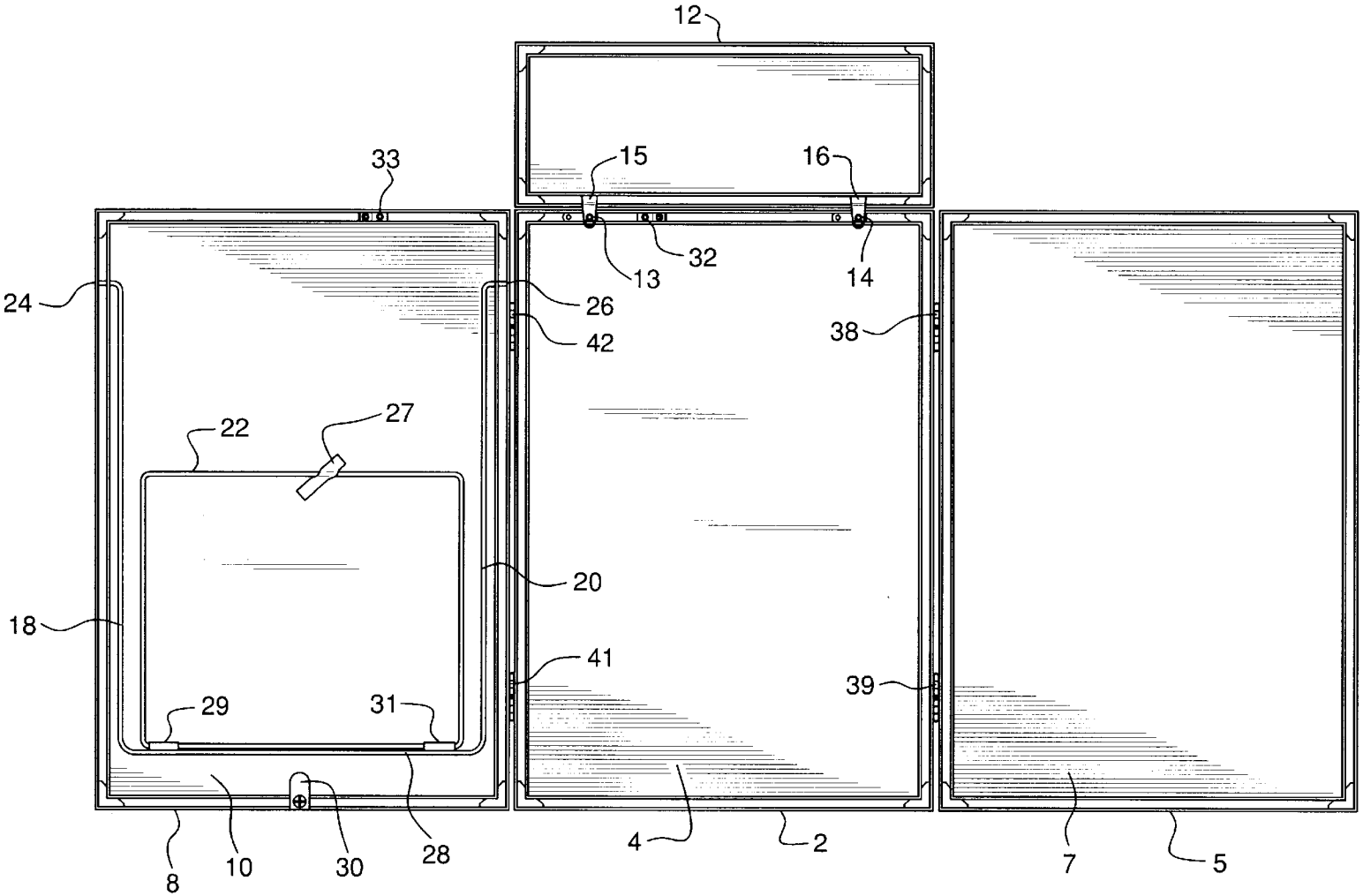
FIG. 2 shows a rear view of the panel display system in its three panel display configuration.
Figure 3:
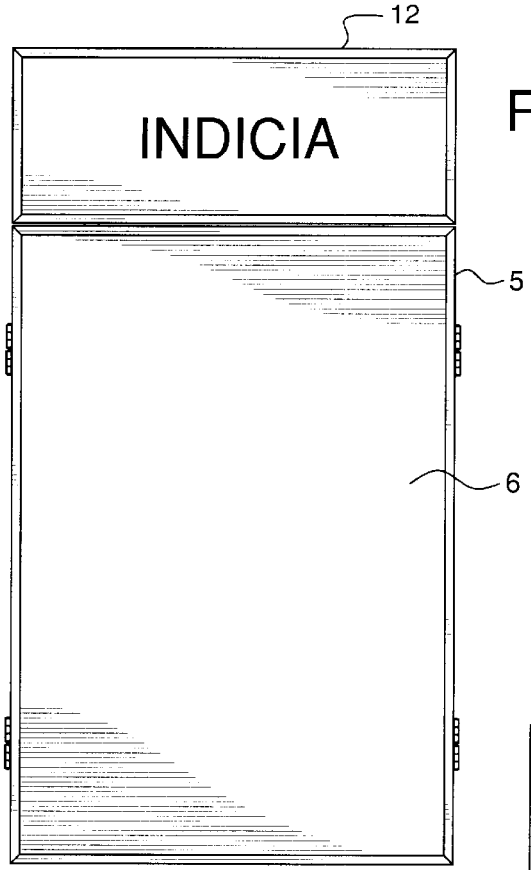
FIG. 3 shows a front view of the panel display system in single panel display configuration, in its vertically upright position.
Figure 4:
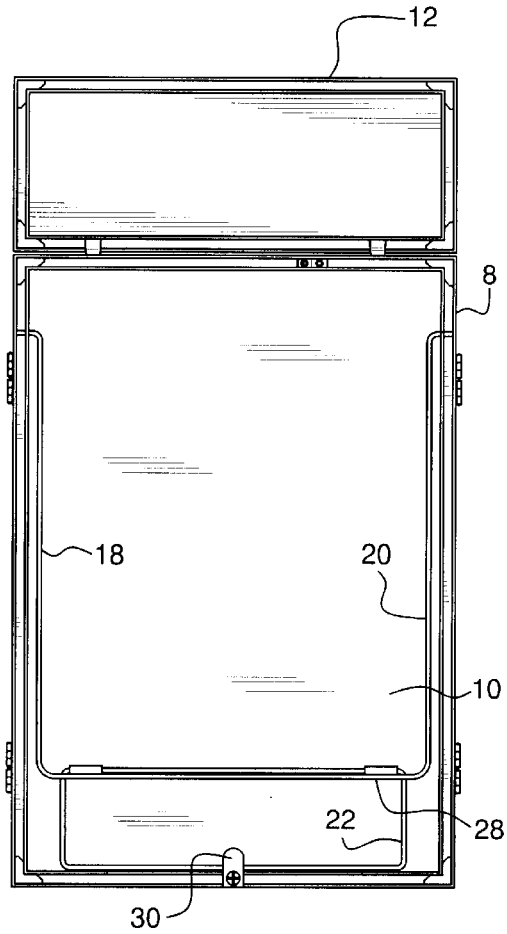
FIG. 4 shows a rear view of the panel display system in single panel display configuration, in its vertically upright position.

FIG. 1 shows the front of panel display system 1 with panel 2, comprising surfaces 3 and 4, panel 5 comprising surfaces 6 and 7, and panel 8 comprising surfaces 9 and 10. Panels 2, 5, and 8 are shown in adjacent alignment, in the self-standing three panel display configuration of the invention. Header 12 is provided with appropriate logo or title. FIG. 2 shows the rear of panel display system with panels 2, 5, and 8 linearly aligned. In the three panel display configuration, header 12 rests on the top of panel 2 and is secured thereto by means of outwardly extending members, e.g. screw attachments 13 and 14, appropriately located on the rear frame of panel 2. Tab members 15 and 16 on header 12 have openings into which members 13 and 14 are inserted to hold the header in place.

Figure 10:
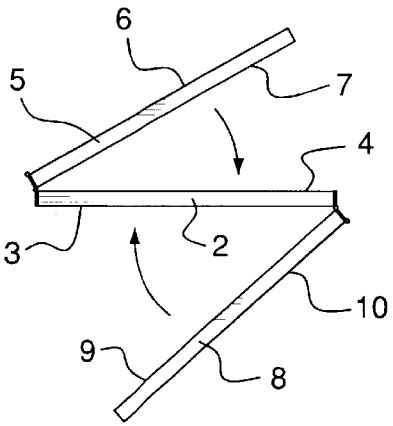
FIG. 10 shows a top view of the panel display system as it is being converted from a three panel display configuration to a single panel display configuration.

From the three panel display configuration shown in FIGS. 1 and 2, panel display system 1 can easily be converted to a single panel display configuration. This is also the configuration which is most readily used for transporting panel display system 1. To effect the single panel configuration, header 12 is removed from members 13 and 14 on panel 2, rotated 180° and reattached to panel 2. Panel 8 is then rotated towards surface 3 of panel 2, as shown in FIG. 10. Rotation of panel 8 continues until there is full surface 3 to surface 9 contact between panels 2 and 8. Panel 5 is rotated towards panel 2, also as shown in FIG. 10. Rotation of panel 5 continues until there is full surface to surface contact between panel surface 4 of panel 2 and surface 7 of panel 5. Panel 5 and particularly its surface 6 becomes the front panel for the single panel display. A display support, comprising leg supports 18 and 20 and base support 22, is secured to surface 10 of panel 8. Leg supports 18 and 20 are pivotally mounted at 24 and 26 to the frame of panel 8. Base support 22 is rotatably mounted by cylindrical connectors 29 and 31 on cross member 28, which interconnects leg supports 18 and 20 and, when not extended out from panel 8, base support 22 is secured to panel 8 by Velcro® tab 27 or similar securing attachment.

For the single panel display configuration, base support 22 is detached from tab 27 on panel 8. Leg supports 18 and 20 are pivoted out a sufficient distance to allow base support 22 to rotate down and to be positioned behind and secured by clip 30 on panel 8. By this arrangement, panels 2,5, and 8 are stacked, as shown in FIGS. 5–7 and 11, to form the single panel display configuration of the invention.

Figure 5:
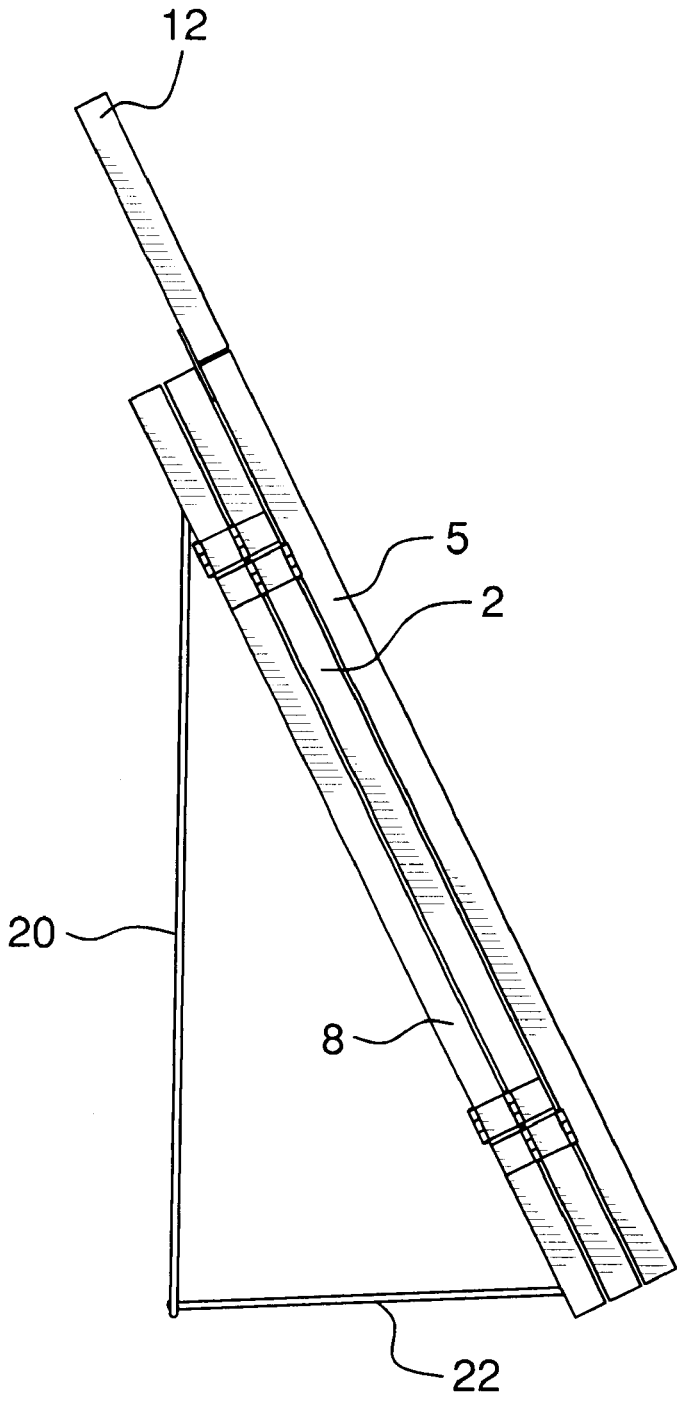
FIG. 5 shows a side view of the panel display system in its single panel display configuration.
Figure 6:
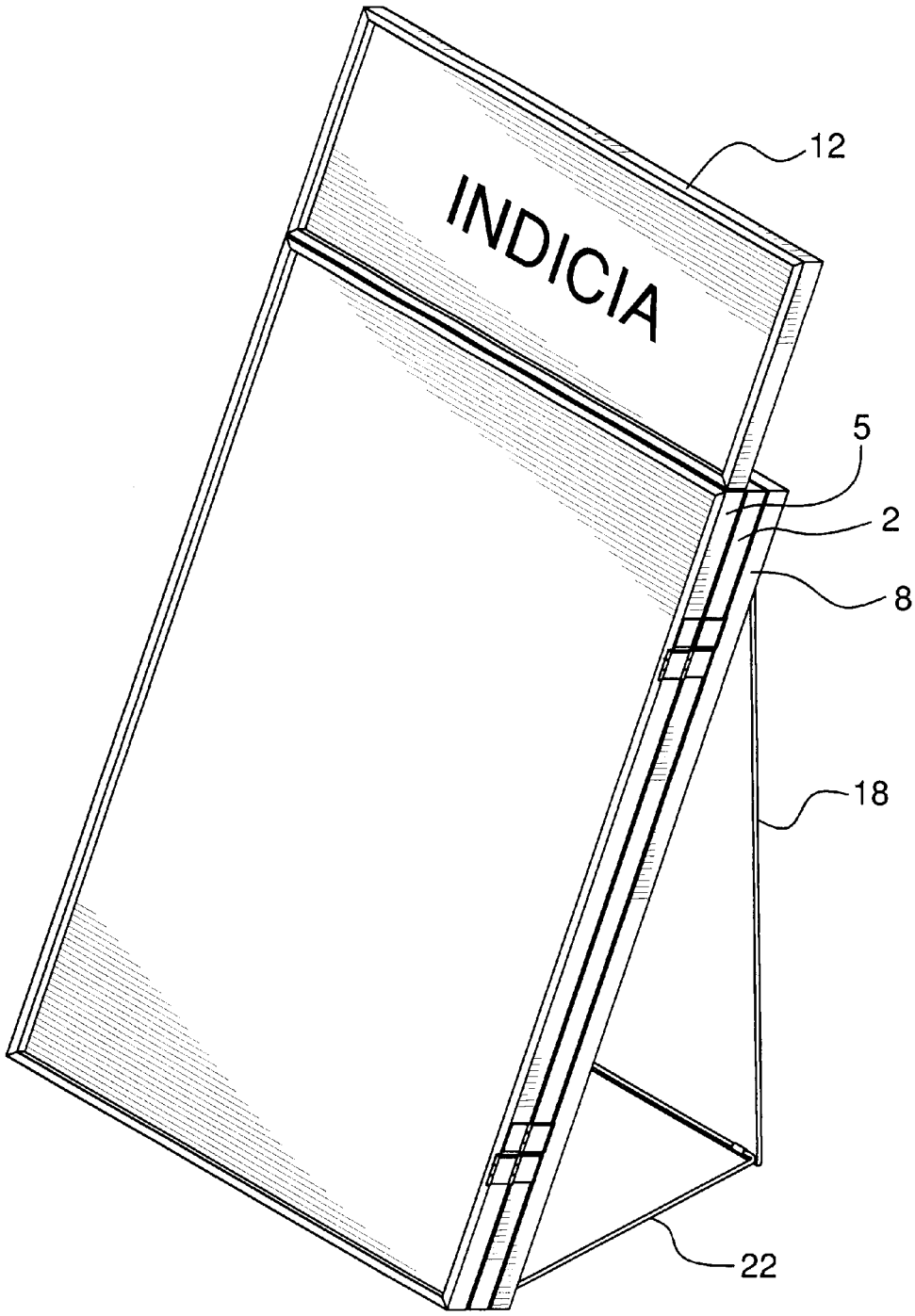
FIG. 6 shows a front perspective view of the panel display system in its single display panel configuration.
Figure 7:
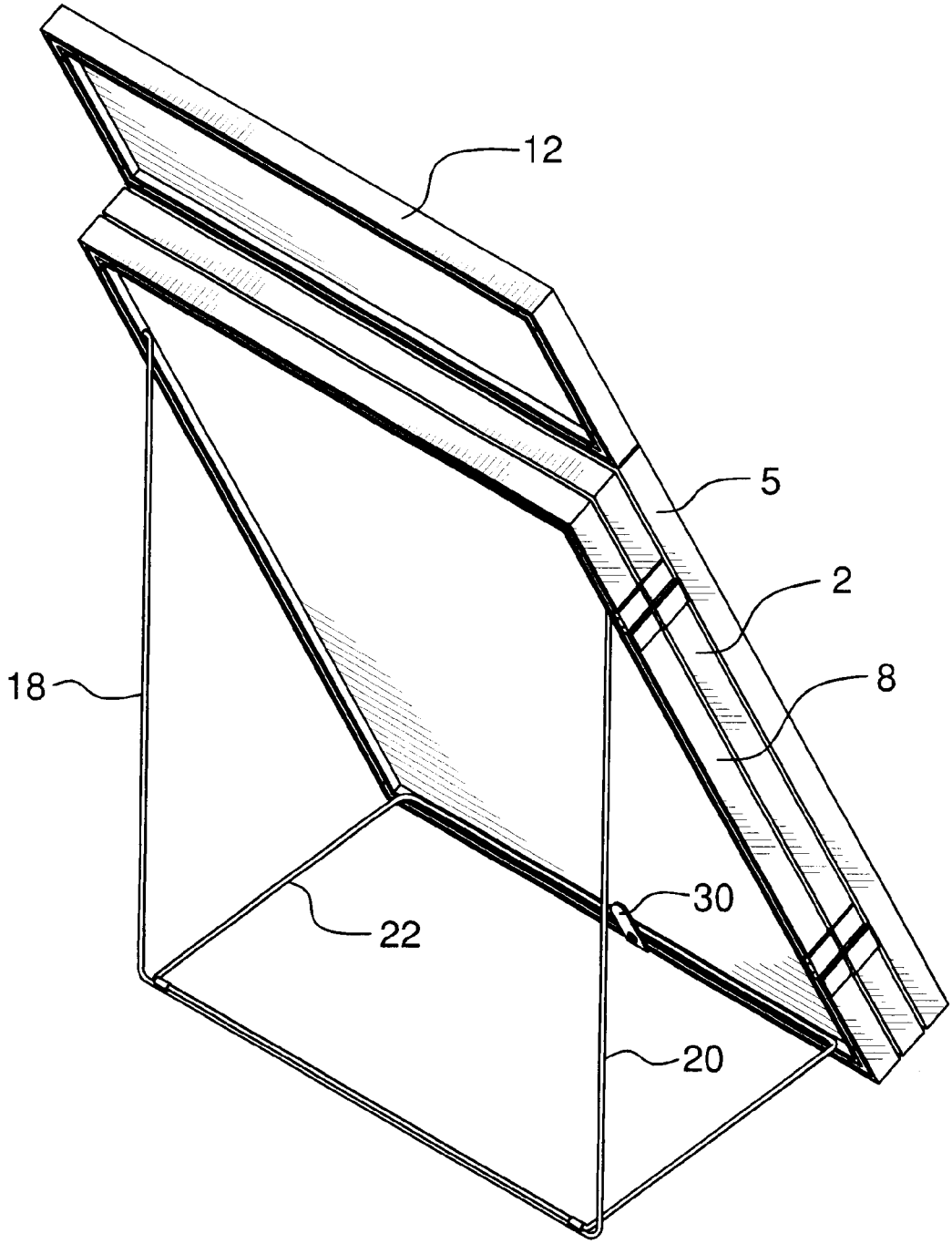
FIG. 7 shows a rear perspective view of the panel display system in its single panel display configuration.
Figure 8:
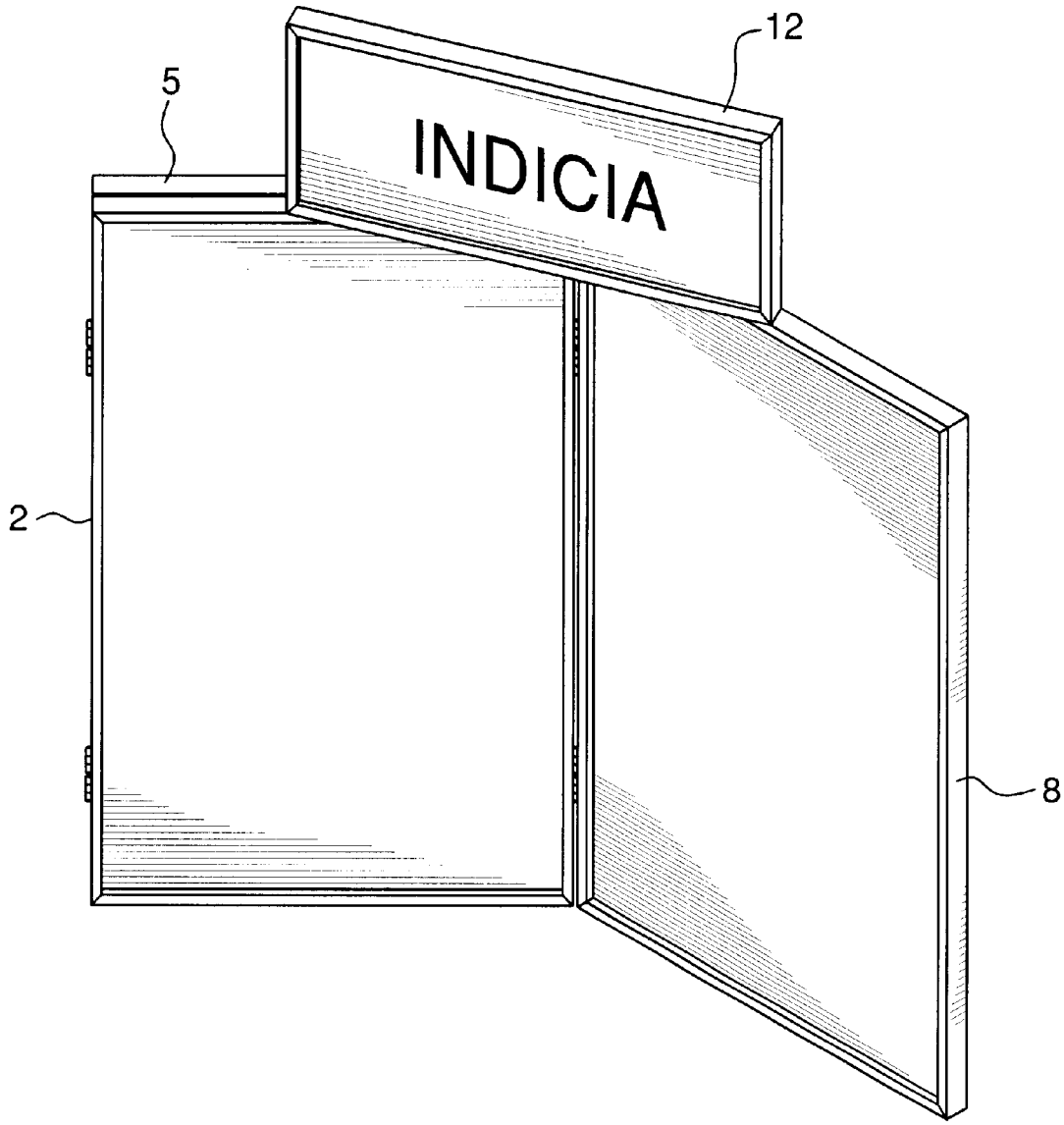
FIG. 8 shows a front perspective view of the panel display system in its dual panel display configuration.
Figure 9:
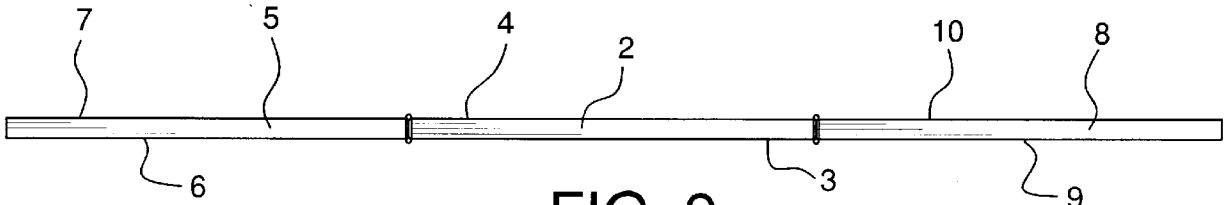
FIG. 9 shows a top view of the panel display system as shown in FIG. 2.
Figure 11:
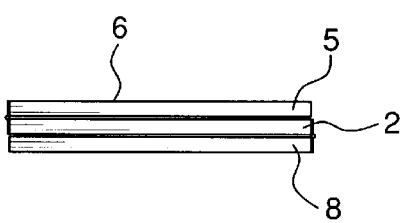
FIG. 11 shows a top view of the panel display system in single panel display configuration.
Figure 12:
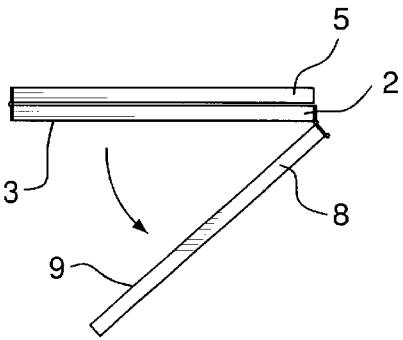
FIG. 12 shows a top view of the panel display system as it is being converted from a single panel display configuration to a dual panel display configuration.

From the single panel display configuration shown in FIGS. 5 to 7, panel display system 1 can easily be converted to a dual panel display configuration. To effect this conversion, base support 22 is rotated up and returned to rear surface 10 of panel 8, where it is secured by tab 27. Header 12 is removed from panel 2. Panel 8 is rotated off of the front surface of panel 2 and returned to the approximate position of the three panel display, as seen in FIG. 12. Panel display system 1 is now self-standing. Panel 5 remains folded, in full surface 4 to surface 7 contact with panel 2. Header 12 is then repositioned over panels 2 and 8, as seen in FIG. 8, and tabs 15 and 16 are secured to the panels by placing the holes in these tabs over outwardly extending members, e.g. screw attachments 32 and 33. Attaching header 12 in this position, securely maintains panel display system 1 in the dual panel configuration.

Of course panel display system 1 can be converted from the three panel display of FIG. 1 directly to the dual panel display of FIG. 8, simply by removing header 12 from panel 2, rotating panel 5 such that it is in full surface 4 to surface 7 contact, and reinstalling the header. Similarly, it can readily be understood that panel display system 1 can be converted directly from its single stacked panel configuration, in its fully folded, transportable state, to either the dual panel display or three panel display configuration.

Panel display system 1 of this invention provides a lightweight, compact, transportable display unit which is readily and easily used as a single panel, dual panel, or three panel display. Set-up and conversion to any of these configurations is quick and simple.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A panel display system for single panel display and multiple panel display configurations, said system comprising multiple interconnected adjacently aligned display panels and means for connecting adjacent panels of the system side by side, said means at all times during the single panel display configuration and multiple panel display configurations, maintaining the connection between adjacent panels, whereby said connecting means is configured to allow adjacent panels to rotate in relation to each other such that all panels are stacked one on another to form the single panel display configuration without removing the connection between the panels and to allow adjacent panels to rotate in relation to each other to form different multiple panel displays configurations without removing the connection between the panels, said display system further comprising means secured to one of the display panels to su oil the panel displays system in the single panel display configuration.

2. The panel display system as in claim 1 wherein the means for connecting adjacent panels comprises hinge connections.

3. The panel display system as in claim 1 wherein the means secured to one of the display panels comprises leg and base supports.

4. The panel display system as in claim 1 further comprising a header and means to secure the header to the display panels at a given position on the system when the system is configured to form the single panel display configuration and alternate positions when the system is configured to form multiple panel displays configurations.

5. The panel display system as in claim 4 wherein the header is removable and is repositioned on the panel display system when the system is formed in the single panel display configuration and when it is formed in a multiple panel display configuration.

6. The panel display system as in claim 1 which comprises three display panels.

7. The panel display system as in claim 6 in which the three panels are aligned in side by side relationship to form a three panel display configuration.

8. The panel display system as in claim 6 in which the three panels are stacked to form the single panel display configuration.

9. The panel display system as in claim 6 wherein two of the three panels are stacked and the third panel is located adjacent to the stack to form a two panel display configuration.

10. A panel display system for single panel display and multiple panel display configurations, said system comprising three interconnected, adjacently aligned display panels and means for connecting adjacent display panels side by side, said means, at all times during the single panel display configuration and multiple panel display configurations, maintaining the connection between adjacent panels, whereby said connecting means is configured to allow adjacent panels to rotate in relation to each other such that all panels are stacked one on another to form the single panel display configuration without removing the connection between the panels, to allow adjacent panels to rotate in an alternate manner to form a dual panel display configuration without removing the connection between the panels, and to allow adjacent panels to rotate in yet another manner to form a three panel display configuration without removing the connection between the panels.

11. The panel display system as in claim 10 wherein the means for connecting adjacent panels comprises hinge connections.

12. The panel display system as in claim 10 further comprising means secured to one of the display panels to support the system when it is in the single panel display configuration.

13. The panel display system as in claim 12 wherein the means secured to one of the display panels comprises leg and base supports.

14. The panel display system as in claim 10 further comprising a header and means to secure the header to the display panels at different positions on the panels when the system is configured to form the single panel display configuration, a dual panel display configuration, and a three panel display configuration.

15. The panel display system as in claim 14 wherein the header is removable and is configured to be repositioned for each panel display configuration.

16. The panel display system as claim 15 wherein the header securing means comprises eye bracket and corresponding screw combination.

17. The panel display system as in claim 10 wherein the three panels are aligned in side by side relationship, when the system forms the three panel display configuration.

18. The panel display system as in claim 10 wherein two of the three panels are stacked and the third panel is located adjacent to the stack when the system forms the dual panel display configuration.

19. A panel display system for single panel display and multiple panel display configurations, said system comprising multiple interconnected adjacently aligned display panels and means for connecting adjacent panels of the system side by side to allow rotation between the panels, said means at all times during the single panel display configuration and multiple panel display configurations, maintaining the connection between adjacent panels, whereby the panels are configured to rotate in relation to each other such that all panels are stacked one on another to form the single panel display configuration and to convert from the single panel display configuration to a multiple panel display configuration, from a multiple panel display configuration to the single panel display configuration and from a multiple panel display configuration to a different multiple panel display configuration, without removing the connection between the panels.

20. The panel display system as in claim 19 wherein the means for connecting adjacent panels comprises hinge connections.

21. The panel display system as in claim 19 further comprising means secured to one of the display panels to support the panel display system in the single panel display configuration.

22. The panel display system as in claim 21 wherein the means secured to one of the display panels comprises leg and base supports.

23. The panel display system as in claim 19 further comprising a header and means to secure the header to the display panels at a given position on the system when the system is configured to form the single panel display configuration and alternate positions when the system is configured to form multiple panel display configurations.

24. The panel display system as in claim 23 wherein the header is removable and is repositioned on the panel display system when the system is formed in the single panel display configuration and when it is formed in a multiple panel display configuration.

25. The panel display system as in claim 19 which comprises three display panels.

26. The panel display system as in claim 25 in which the three panels are aligned in side by side relationship to form a three panel display configuration.

27. The panel display system as in claim 25 in which the three panels are stacked to form the single panel display configuration.

28. The panel display system as in claim 25 wherein two of the three panels are stacked and the third panel is located adjacent to the stack to form a two panel display configuration.

* * * * *